US007942151B2

(12) United States Patent
Maurello

(10) Patent No.: US 7,942,151 B2
(45) Date of Patent: May 17, 2011

(54) HEMORRHOID TREATMENT DEVICE

(76) Inventor: John Maurello, Oceanside, NY (US)

( * ) Notice: Subject to any disclaimer, the term of this patent is extended or adjusted under 35 U.S.C. 154(b) by 0 days.

(21) Appl. No.: 12/655,137

(22) Filed: Dec. 24, 2009

(65) Prior Publication Data

US 2010/0212672 A1 Aug. 26, 2010

Related U.S. Application Data

(62) Division of application No. 11/325,258, filed on Jan. 5, 2006, now Pat. No. 7,677,250.

(51) Int. Cl.

| | |
|---|---|
| ***A61G 15/00*** | (2006.01) |
| ***A47K 13/00*** | (2006.01) |
| ***A47K 3/022*** | (2006.01) |
| ***E03C 1/20*** | (2006.01) |

(52) U.S. Cl. ..... 128/845; 4/237; 4/238; 4/239; 4/443; 4/446

(58) Field of Classification Search ..... 128/845, 128/878, 95.1, 98.1, 103.1; 4/237, 238, 239, 4/244.3, 245.6, 245.7, 444, 446, 447, 420.3; 297/452.22–452.24

See application file for complete search history.

(56) References Cited

U.S. PATENT DOCUMENTS

| | | | | |
|---|---|---|---|---|
| 4,244,063 | A * | 1/1981 | Bayard | 4/237 |
| 4,457,029 | A * | 7/1984 | Matthews | 4/237 |
| 4,709,431 | A | 12/1987 | Shaktman | |
| 4,761,843 | A | 8/1988 | Jay | |
| 5,178,627 | A | 1/1993 | Hudock | |
| 5,288,132 | A * | 2/1994 | Vaughn | 297/452.22 |
| 5,924,423 | A | 7/1999 | Majlessi | |
| 6,716,229 | B2 | 4/2004 | Toth | |
| 2004/0194197 | A1 | 10/2004 | Eft | |

FOREIGN PATENT DOCUMENTS

| | | |
|---|---|---|
| JP | 10085156 A1 | 4/1998 |
| WO | WO 97/07727 | 3/1997 |
| WO | WO 2008/020751 | 2/2008 |

OTHER PUBLICATIONS

UKIPO—Search Report, Sep. 21, 2007.

* cited by examiner

*Primary Examiner* — Patricia M Bianco
*Assistant Examiner* — Ophelia Hawthorne
(74) *Attorney, Agent, or Firm* — Leo G. Lenna

(57) ABSTRACT

The present application is directed to a seat having a hard, firm surface designed to treat hemorrhoids. The hard, firm surface of the seat is configured to have a void and two opposing pressure applying points designed to place positive pressure on the area surrounding a hemorrhoid so as to develop a negative pressure within the body which causes the body to draw the hemorrhoids back up into the body.

4 Claims, 8 Drawing Sheets

HEMORRHOID TREATMENT DEVICE

CROSS REFERENCE TO RELATED APPLICATIONS

This is a divisional application of U.S. patent application Ser. No. 11/325,258 now allowed, filed on Jan. 5, 2006 now U.S. Pat. No. 7,677,250, the contents of which are incorporated herein by reference in its entirety.

FIELD OF THE INVENTION

The present invention relates to an adjustable seat designed to treat hemorrhoids instead of just alleviating the symptoms associated with hemorrhoids. Many seats on the market today for hemorrhoids are designed simply to alleviate the symptoms that are associated with hemorrhoids and do not treat the condition. These seats are usually soft cushioned seats designed to support hemorrhoids that protrude from the anus and surrounding area so as to reduce discomfort.

The adjustable multi-leveled seat creates a negative pressure in the anus area when sat on which results in making hemorrhoids that extend from the body being drawn back into the anus. Once these hemorrhoids are drawn back up into the anus the uncomfortable symptoms associated with the hemorrhoids disappear.

BACKGROUND OF THE INVENTION

This invention relates to treating hemorrhoids to eliminate pain and discomfort associated with hemorrhoids. More specifically, it relates to a device for the relief of anal pain arising from hemorrhoids (piles) or other anal problems by using negative pressure for the body to detract hemorrhoids back into the anus.

A number of devices have been provided in the art for relief of anal protrusions, namely hemorrhoids, but most of them are not suitable for contingent use by the sufferer himself, or only alleviate the symptoms and do not really treat the condition. For example, available on the market today is a U-shaped cushioned seat that is used by hemorrhoid suffers in order to suspend the area where the hemorrhoid is located in air while providing a cushion for the rest of the body. This cushion is only a short time comfort and soon becomes uncomfortable itself.

Another main treatment of hemorrhoid today is the use of creams to shrink hemorrhoid. Often a cream and/or medicated patch is placed on the hemorrhoid in attempt to shrink the hemorrhoid and provide some comfort to the sufferer. The creams and patches are often not easy to apply alone and are usually greasy and have an unpleasant smell making them hard to use in public.

Another device used to treat hemorrhoids available today is described in European patent EP-A-0672400 which is incorporated herein by reference. This patent describes a cooling cylindrical device for removal of pain and therapeutic treatment of hemorrhoids and anal fissures comprising a hollow insert, finger or bulb shaped for insertion into the anus with at least one inlet and/or outlet openings at its upper base, one or two tubes connected to these openings, and at least one container for cold liquid circulation starting from a container through an inlet tube into the cylindrical insert, the liquid being driven back through the outlet opening and through the second tube to the container, under the influence of a pump connected to the container or back to another container under the influence of gravity. This device is not only complicated to use but the use of the device itself makes the user even more uncomfortable.

Still another device available is described in U.S. Pat. No. 4,331,151. This patent describes a hemorrhoid bandage or cold pack, for positioning within a human anal canal, formed of a hollow, thin wall, roughly cylindrically shaped body having an inner end and an outer end. The body is transversely divided into two parts by a central panel extending longitudinally from the outer end towards the inner end, but having an open area adjacent the inner end. A tube, which is coaxial with the body, extends from the inner to the outer end and opens exteriorly of the body at each end. A fluid inlet continuously supplies fluid into one body part through the outer end, which fluid flows through the panel opens area at the inner end, and then out of the other body part through a fluid drain opening communicating therewith.

The two interior parts may be further subdivided by transverse ribs extending between the panel and the body exterior wall to form longitudinally extending channels for controlling the direction of the fluid flow through the body. By using a relatively cool fluid, such as cool water, the bandage may be used to provide a controlled temperature, for extended periods of time, within the rectal area in connection with treatment of hemorrhoids. This, as with the previous patent device mentioned above, is uncomfortable itself.

Still another device available is described in U.S. Pat. No. 4,563,182. This patent describes yet still another anal insertion device. The method of treating hemorrhoids which comprises inserting into the rectum of a subject afflicted therewith a substantially cylindrical shaped insert, comprising a water swellable polymer having a water content of at least 35% by weight, the insert having previously been subjected to a temperature below 0.degree. C. for a sufficient amount of time to freeze the free water therein, and maintaining the insert with at least a portion thereof outside the sphincter muscle. As with the previous devices, this is uncomfortable to the user.

Still another anal insertion device is described in U.S. Pat. No. 4,841,970. Here a cryogenic proctologic insert for treating hemorrhoids by lowering the surface temperature of the affected portion of the rectal canal is described. The insert is formed of a tubular plastic portion filled with a congealable fluid. Extended heat transfer surfaces are provided in the interior of the insert to promote heat transfer to and from the fluid.

Yet still another device to treat hemorrhoids is described in U.S. Pat. No. 4,537,194 and relates to an applicator used to apply a frozen solid such as ice to a wound or injury to treat the wound or injury. A first container has an open top of a predetermined size, a tapered side wall and a bottom having a central opening there through, and a second container has a shape conforming at least in part to that of the first container, an open top and a closed bottom. The two containers are fitted together by placing the bottom of the first container into the top of the second container. The device can then be filled with liquid and frozen until needed. When in use as an applicator, the second container is removed and the first container serves as a handle for applying the frozen solid. Again, inserting this device into the anal canal is often uncomfortable to the user.

Other devices are known of greater or lesser complication and practicality but do not really treat the problem but simply provide relief for pain and discomfort associated with hemorrhoids. There still remains the need, however, for a simple and inexpensive means of treating hemorrhoids that can be used in public to eliminate the discomfort associated with outwardly extending hemorrhoids by eliminating them without inserting anything into the anal canal of the user. As will become apparent from the following description, the present invention is a novel approach to treating hemorrhoids instead just easing the symptoms.

The present invention addresses the shortcomings associated with the devices and ointments available on the market today as well as providing additional benefits.

All of the references cited in the specification are incorporated herein by reference.

SUMMARY OF THE INVENTION

The present invention is directed to a hemorrhoid seat. The hemorrhoid seat has a first hard surface having a top side, a bottom side, and at least three side walls wherein at least one of the side walls has at least one track. The seat also has a second hard surface having a top side, a bottom side, and at least three side walls wherein at least one of said side walls comprises at least one tract. The seat also has at least one rail sized to fit within at least one of the tracks located on at least one of the side walls of the first and the second hard surfaces so as to slidably attach the first and the second surfaces together. The first and second hard surfaces can be positioned along the tract so as to create a gap of different sizes. The hemorrhoid seat has a handle on at least one surface of the seat which is used to carry the hemorrhoid seat.

In one embodiment of the invention, the first and a second surface of the hemorrhoid seat have two tracks attached to each surface wherein the two tracks on the first surface substantially align with the two tracks on the second surface. The two surfaces of the seat have at least two rails that are positioned within the tracks so as to allow the first surface and the second surface to slide along the rails forming a gap between the surfaces. The gap can be made larger by sliding the surfaces away from one another on the tracks or made smaller by sliding the surfaces towards one another on the tracks provided. The tracks are designed with a stop that even at the closet position together a gap still remains.

In one embodiment of the invention, the hemorrhoid seat further comprises a hinge means on the rails of the seat which allows the rails to fold in such away that the first surface of the seat rests on top of the second surface of the seat. This, considered the closed position, makes it easier for the seat to be carried and/or stored. The seat may also come with a carrying bag that fits the seat when in the closed position.

An alternative embodiment of the invention is directed to a hemorrhoid seat comprising a hard surface having a top side, a bottom side, and at least three side walls wherein the hard surface has a hole. The hole maybe round, oval, triangle, square or rectangle. The hole is functionally the same as the gap between the two surfaces. The hole may only go partially through one surface of the seat or may extend form the top side of the hard surface to the bottom side of the hard surface.

The hole maybe located substantially equidistant from the side walls so that when a person sits on the hard surface, the hemorrhoid can be positioned within the hole and the hard surface applies pressure to the area around the hemorrhoid. This pressure in turn causes a negative pressure within the body that draws the hemorrhoid back into the body within minutes. The same procedure can be done using the seat having a gap. In other words, the person can position herself or himself on the hard surface of the seat so that the hemorrhoid is located within the gap and the hard surfaces are applying positive pressure to the area surrounding the hemorrhoid. The gap can be adjusted so as to position the hemorrhoid in the gap so as to create a negative pressure inside the area around the hemorrhoid and the hemorrhoid is drawn back into the body, thus providing relief for the user.

Still another embodiment of the invention is directed to a hemorrhoid seat kit comprising a hemorrhoid seat having a first hard surface having a top side, a bottom side, and at least three side walls wherein at least one of the side walls comprises at least one track. The hemorrhoid seat also has a second hard surface having a top side, a bottom side, and at least three side walls wherein at least one of the side walls comprises at least one track and at least one rail sized to fit within at least one of the tracks located in at least one of the side walls of the first and the second hard surfaces so as to slidably attach the first and the second surfaces together.

The kit also comprises side blocks designed to partially fit within a gap created when the first hard surface is slide away from the second hard surface. Placing the blocks within the gap can create a gap having four walls wherein not all of the walls are on the same plane. Having each surface on a different plane may provide the correct pressure around the hemorrhoid so as to draw the hemorrhoid up into the body.

In other words, this kit allows the hemorrhoid seat to either have a gap formed by two walls, if the blocks are not used, or a gap formed by four walls if the blocks are used. This provides a mechanism to design the gap having two different formations so as to allow the user to use the formation that places just the right amount of positive pressure on the area surrounding the hemorrhoid so as to create a negative pressure with the body forcing the hemorrhoid back into the body. The hemorrhoid seat kit may also come with a carrying case, for example a carrying bag.

In still another embodiment of the invention the hemorrhoid seat comprises a hard surface having a top side, a bottom side, and at least three side walls wherein at least one of the side walls have a void producing a gap. The void that produces the gap may extend through the seat to the other side or may go only partially through the seat so as to appear as a carved out portion of the seat. The gap may be equipped with short rails that extend from one side of the gap to the other and can be used to snap gap adjusting blocks.

Yet another embodiment of the invention, the hemorrhoid seat is designed to fit either directly on the toilet bowl or the toilet seat when being used. The added benefit to this embodiment is that any bleeding or discharge because of the hemorrhoid goes directly into the toilet making cleanup easy.

The present invention is shown in the figures and described more fully in the detailed description of the figures below.

Figure 1:
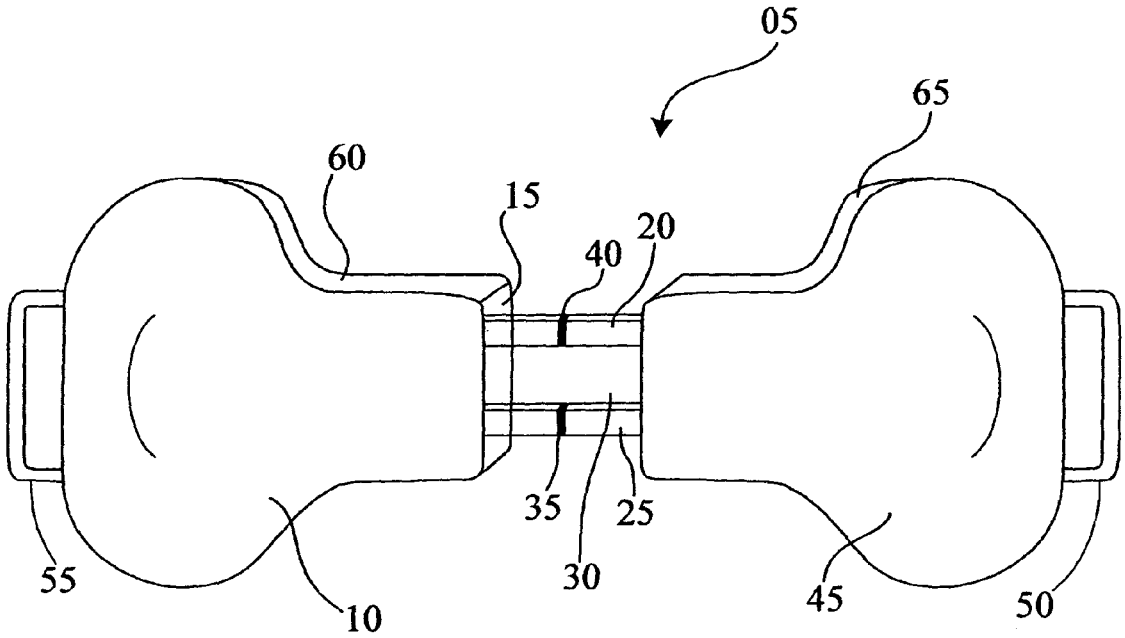
FIG. 1: TOP VIEW OF THE HEMORRHOID
(05) Hemorrhoid seat
(10) left hard surface seat
(15) inner slide surface
(20) first slide rail
(25) second slide rail
(30) gap
(35) folding point of first hinge
(40) folding point of second hinge
(45) right hard surface seat
(50) right handle
(55) left handle
(60) side portion of left hard seat
(65) side portion of right hard seat

(200) portion of hard seat
(205) hard surface
(210) side portion of hard seat
(215) inner slide surface
(220) highest adjustment rail track
(225) lowest adjustment rail track
(230) intermediate adjustment rail track
(235) first center adjustment rail track
(240) second adjustment rail track (245) right rail with expansion block
(250) left rail with expansion block
(255) handle
(260) right rail
(265) left rail
(270) Carrying bag
(275) bag handle
(280) bag zipper

Figure 4:
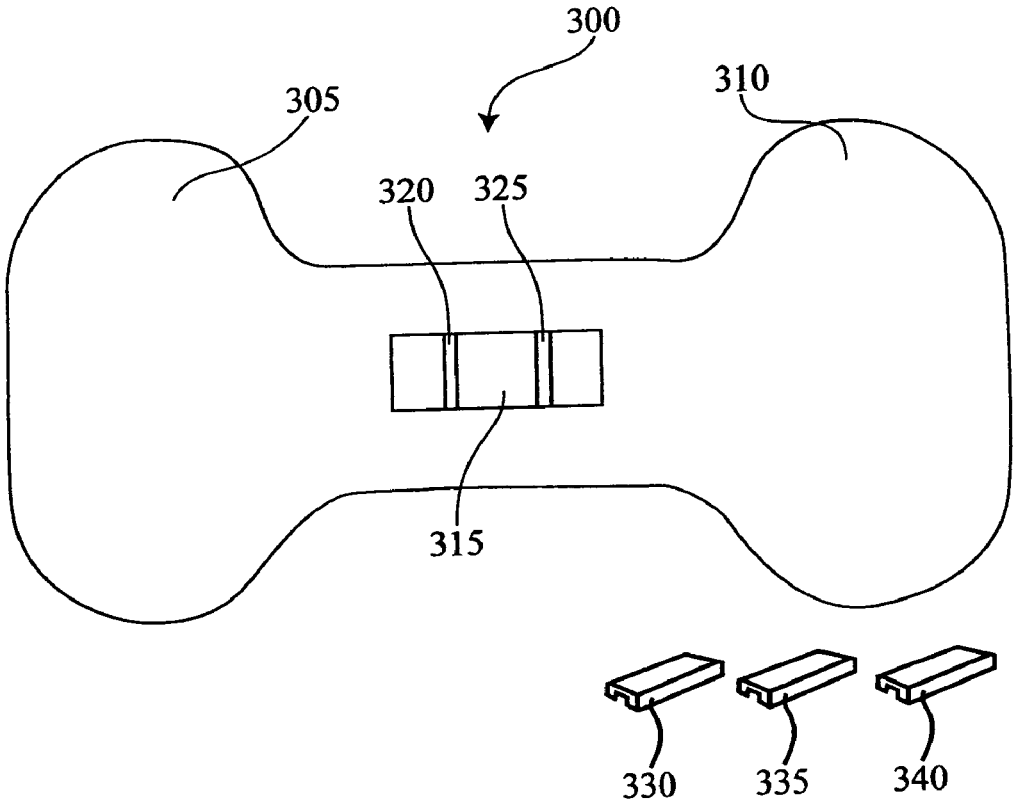

FIG. 4: TOP VIEW OF ONE PIECE HARD SURFACE SEAT (300) hemorrhoid seat
(305) right hard surface
(310) left hard surface
(315) gap
(320) rail for gap adjusting blocks
(325) second rail for gap adjusting blocks
(330) small gap adjusting block
(335) medium gap adjusting block
(340) large gap adjusting block FIG. 5: Top view of Toilet seat (400) Toilet Hemorrhoid seat
(405) Attachment hinge
(410) Body of seat
(415) First Void
(420) First pressure applicator
(425) Restricted portion of pressure applicator
(430) Second pressure applicator
(435) Second void
(440) Track pins
(445) Tracks
(450) seat stabilizers FIG. 6: Top View of Toilet seat with cover.

Figure 7A:
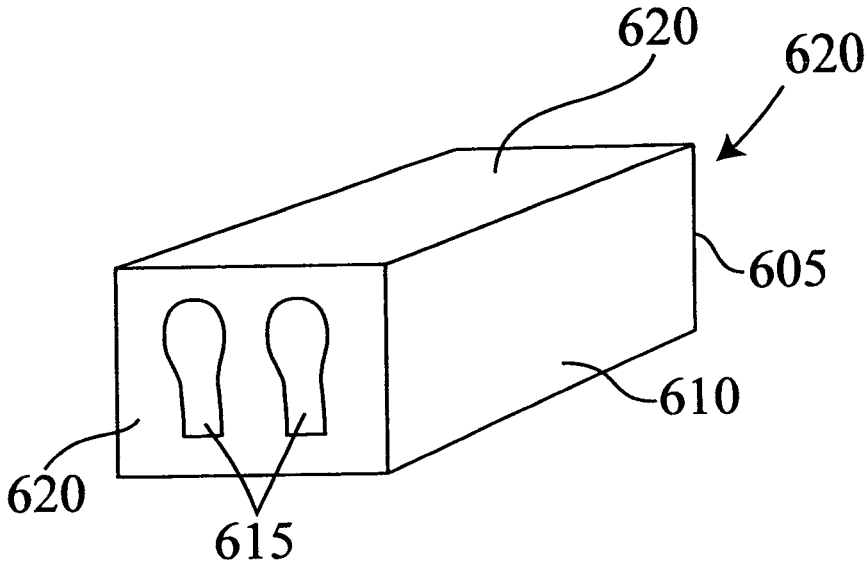

(500) Toilet seat with cover
(505) Thin skin cover
(510) hinges
(515) tracks
(520) body of seat
(525) first pressure applicator
(530) track pins
(535) first void
(540) second pressure applicator
(545) second void
(550) restricted portion of applicator FIG. 7*a*: Side View of collapsible foot stool.

Figure 7B:
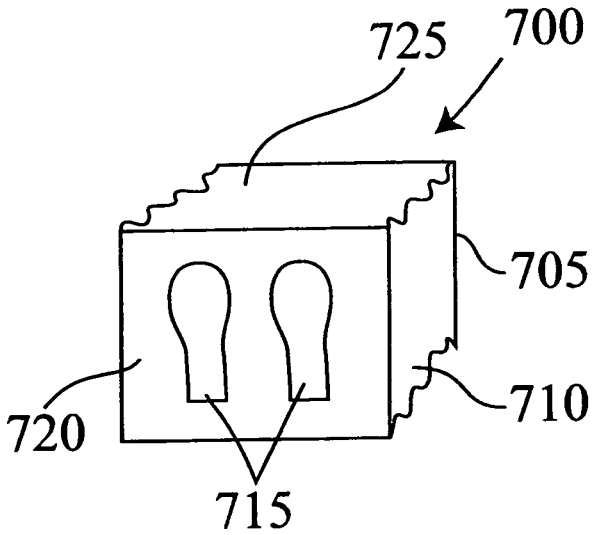

(600) extended foot step
(605) bottom
(610, 620) sides
(615) top
(625) foot rest FIG. 7*b*: Side view of collapsible foot stool in collapsed position.

Figure 8:
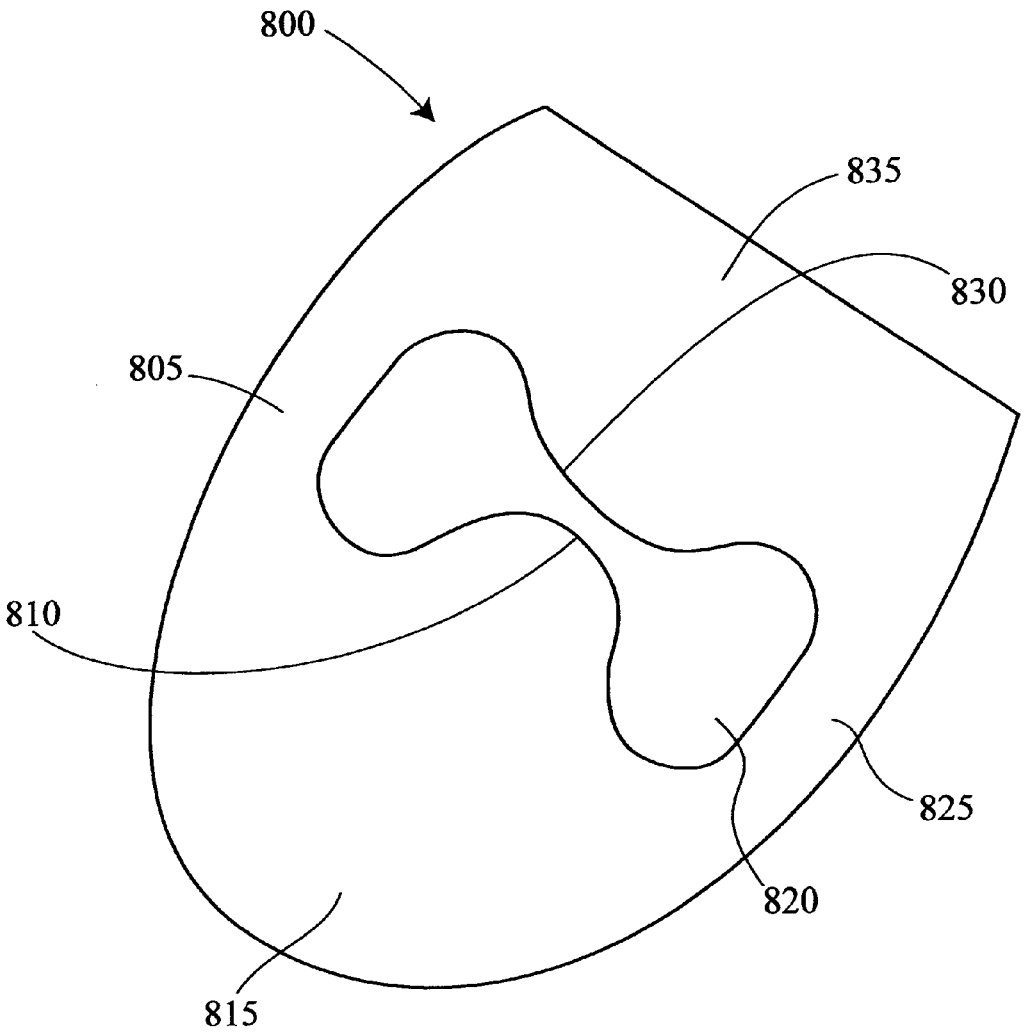

(700) collapsed foot step
(705) bottom
(710, 725) sides
(715) foot rest
(720) top FIG. 8: Top View of Portable One Piece Hard Surface Seat (800) portable one piece hard surface seat
(805) right side of seat
(825) left side of seat
(815) front side of seat
(835) back side of seat
(820) void
(810) extension of front side of seat forming first pressure point
(830) extension of back side of seat forming second pressure point.

DETAILED DESCRIPTION OF THE INVENTION

The invention described herein is directed to a hard surface hemorrhoid seat. In particular, a hard surface hemorrhoid seat having a gap that is designed to apply positive pressure to the area surrounding a hemorrhoid so as to cause a negative pressure inside the body. The negative pressure draws the hemorrhoid back up into the body making the user more comfortable without the use of greasy creams that only sometime work.

There are three main embodiments of the invention that are depicted in FIGS. 1-8.

FIG. 1 shows a top view of the hard surface hemorrhoid seat of the invention. The hemorrhoid seat (05) has a left hard surface (10) and a right hard surface (45). The seat is rigid as shown by the thickness of the side portion (60) of the left seat (10) and the side portion (65) of the right seat (45). The seat is made of a hard, durable material that has very little flexibility, if any. Each of the seat portions may be equipped with handles (50, 55). Connecting the left seat (10) and the right seat (45) are support rails (20) and (25). These rails fit within channels (not shown) of the inner slide surface (15) of each seat portion and allow the left seat (10) and the right seat (45) to move towards and way from each other to adjust the size of the gap (30) created by these seats. The first rail (20) has a hinge means (40) and the second rail (25) also has a hinge means that allows the rail to fold, thus permitting the left seat (10) to fit on top of the right seat (45) for easy storage.

Adjusting the size of gap (30) is important to the operation of the invention because it is critical that the edge of the hard surface be positioned so as to place positive pressure on the area around the hemorrhoid. This pressure causes the body to draw the hemorrhoid back into the body.

Figure 2:
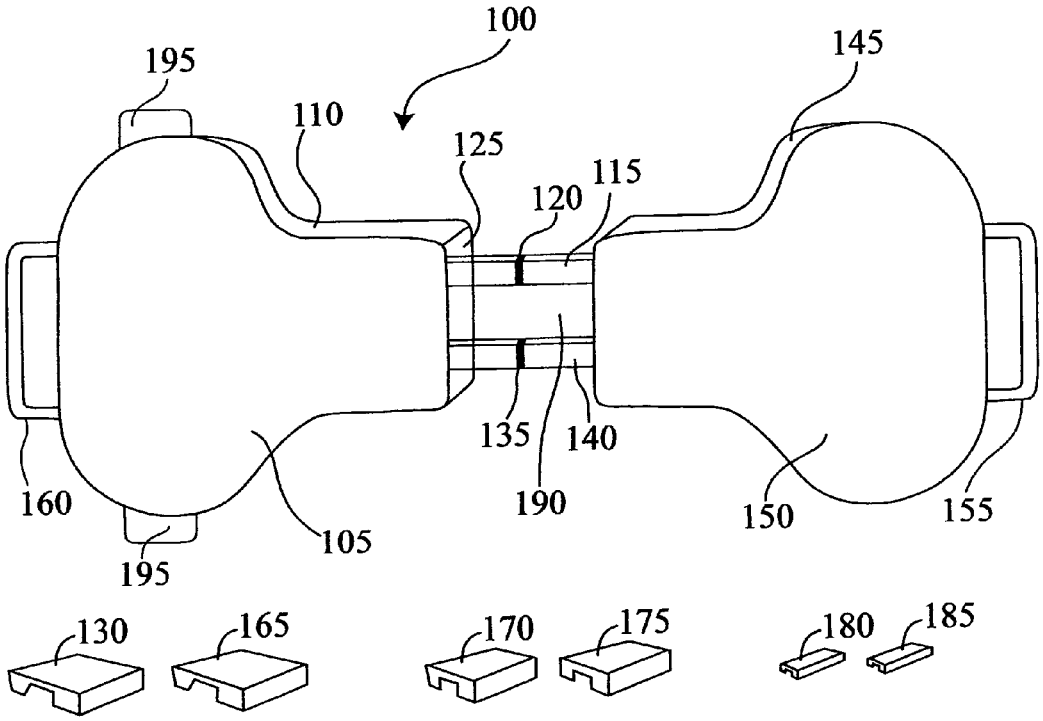
FIG. 2: ALTERNATIVE TOP VIEW OF HARD SEAT
(100) hemorrhoid seat
(105) left hard surface seat
(110) side portion of left hard seat
(115) first slide rail
(120) folding point of first hinge (125) inner slide surface
(130) large gap transforming block
(135) folding point of second hinge
(140) second slide rail
(145) side portion of right hard seat
(150) right hard surface seat
(155) right handle
(160) left handle
(165) large gap transforming block
(170) medium transforming block
(175) medium transforming block
(180) small transforming gap
(185) small transforming block
(190) gap

This is further shown in FIG. 2 of the invention. FIG. 2 shows an alternative top view of the invention that is designed to not only change the size of the gap in two directions but, using the placement of blocks, allows the gap to be changed in all four directions. The seat (100) has the same features shown in FIG. 1, namely a left hard surface (105) and a right hard surface (150). The seat is rigid as shown by the thickness of the side portion (110) of the left seat (105) and the side portion (145) of the right seat (150). The seat is made of a hard, durable material that has very little flexibility, if any. Each of the seat portions may be equipped with handles (155,160). Connecting the left seat (105) and the right seat (150) are support rails (15) and (140). These rails fit within channels (not shown) of the inner slide surface (125) of each seat portion and allow the left seat (105) and the right seat (150) to move towards and away from each other to adjust the size of the gap (190) created by these seats.

The first rail (115) and the second rail (140) both have hinge means (120. 135 respectively) that allow the rails to fold, permitting the left seat (10) to fit on top of the right seat (45) for easy storage. In addition to these features, the rails are designed to accept gap adjusting blocks that are grooved to fit on top of the rails and adjust the size of the gap. Three sizes are shown, small gap adjusting blocks (180, 185), medium gap adjusting blocks (170,175) and large gap adjusting blocks (130, 165). These blocks can be used together or one at a time to customize the size of the gap for the particular user. This further assures that the person gets the right amount of pressure applied to the exact spot so as to draw the hemorrhoid back up into the body.

The gap adjusting blocks are grooved on at least one side to fit on top of the rails so as to adjust the width of the gap. The seats my then be moved apart to adjust the length of the gap. Although only small, medium and large blocks are shown, many other blocks can be used to achieve the same function. The blocks can also be fitted with clips so as to keep the blocks in place while being used.

Figure 3:
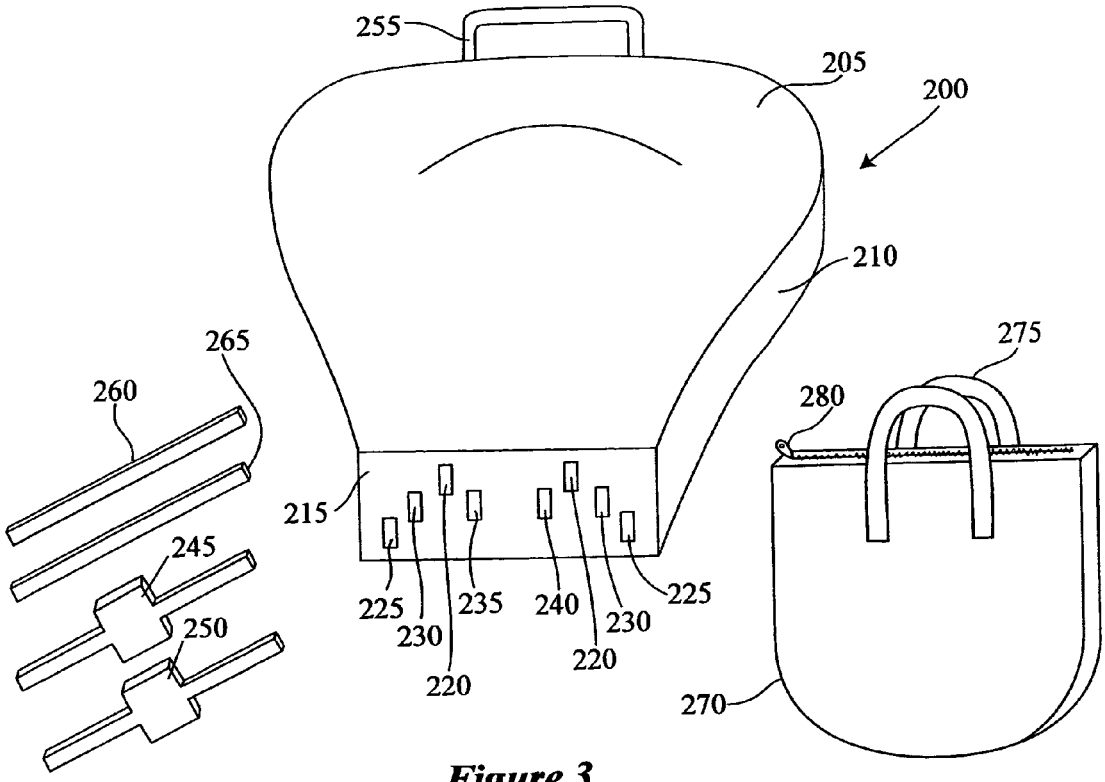
FIG. 3: PARTIAL SIDE VIEW OF HARD SEAT WITH ACCESSORIES.

To further provide the correct gap, FIG. 3 shows another embodiment of the invention. FIG. 3 shows one portion of the hemorrhoid seat of the invention positioned so as to display the inner rail surface. The hemorrhoid seat (200) of the invention has a hard surface (205) and a side portion (210). The side portion (210) may vary in thickness depending on the material used to make the seat. The more rigid the material, the thinner the seat can be. In the alternative, the less rigid the material used to make the seat, the thicker the side portion (210). However, the seat must be thick enough so as to allow multiple rail tracks in the inner rail surface (215).

In other words, the inner rail surface (215) must be able to accommodate rail tracks for the placement of guide rails at different levels and positions. As shown in FIG. 3, the inner surface may be equipped with highest rail tracks (220), intermediate rail tracks (230), lowest rail tracks (225) and a first center track (235) and a second center track (240). These various tracks allow for different heights and levels of the edges of the gap. In other words, using plain rails (260,265) or rails with gap adjusting blocks directly attached (245,250) are placed in the highest rail track (220) the gap adjusting blocks may protrude out of the gap area. This may permit a user to achieve the exact pressure needed for the body to draw the hemorrhoids into the body.

As is true with using the intermediate rail tracks or the lowest rail tracks. If no blocks are needed then the center rail tracks (235,240) can be used. These rails can be equipped with hinges to allow them to fold and the two seat portions lay on top of one another. In the alternative the rails can be removed and each piece placed in the bag separately. Both embodiments are within the scope of the invention.

FIG. 4 shows an alternative embodiment of the invention, namely a one piece hemorrhoid seat. As with the other embodiment the hemorrhoid seat (300) has a right hard surface (305) and a left (310) hard surface which are directly connected together. Positioned in hard seat surface is a gap 315. The gap may be a hole that goes directly through to the other side of the seat or a deep groove that falls short of going through the opposite surface. The gap may be square, rectangular, circular or any other shape having edges.

Positioned within the gap may be short rails that extend from one side to the other and are used to accept gap transforming blocks. As with the other embodiments these blocks may be small (330) medium (335) or large (340) in size. This seat functions the same way as the embodiments described above, namely providing a gap so that positioned correctly will allow a pressure to be applied to the area surrounding a hemorrhoid so as to place positive pressure on this area. This in turn causes a negative pressure to form inside the body near the hemorrhoid causing it to be draw back into the body. Since no rail systems are present, this could be produced more economically than the other embodiments and still have the same results.

Figure 5:
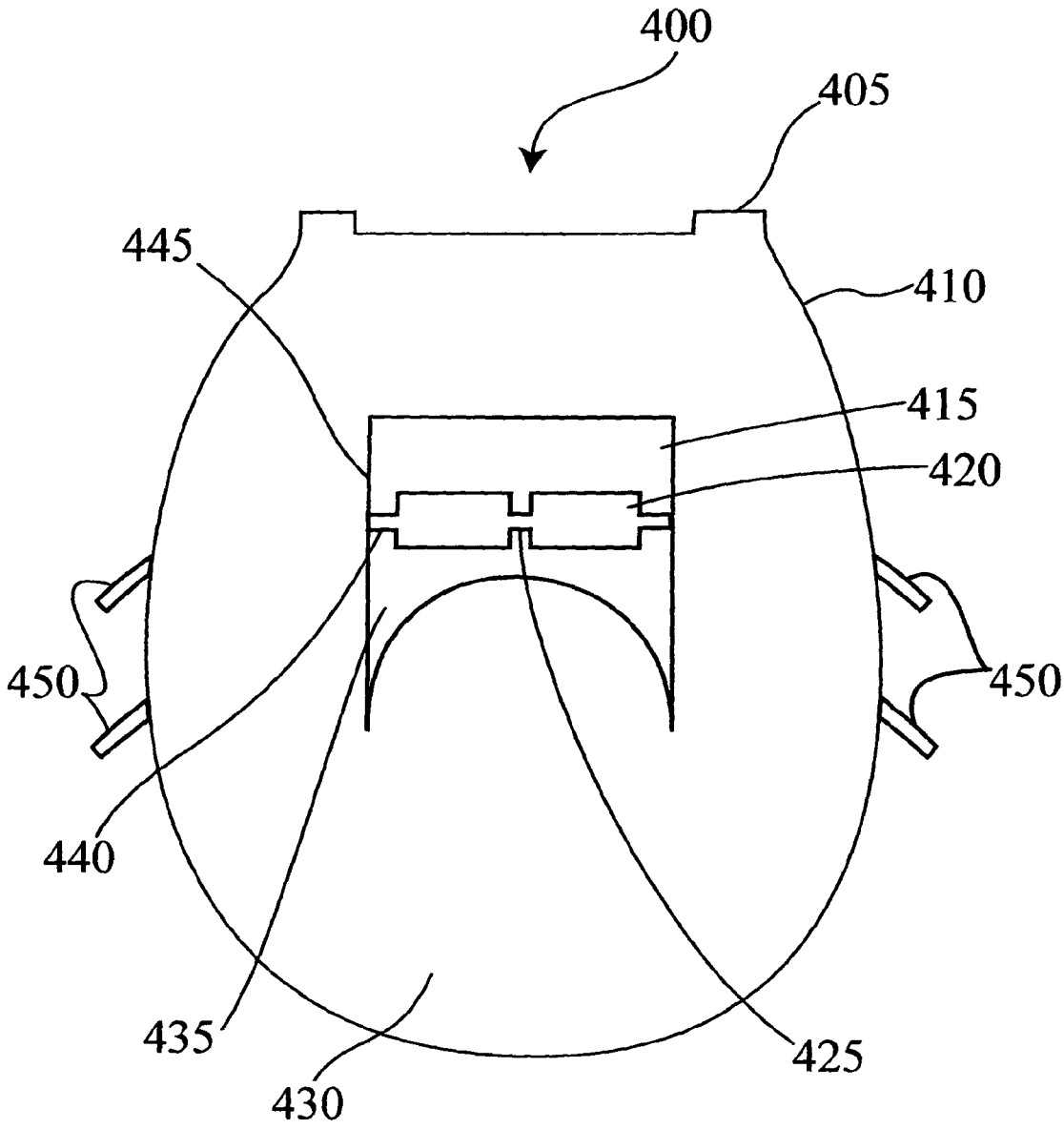

FIG. 5 illustrates another embodiment of the invention. In this embodiment the hemorrhoid seat is configured as a toilet seat that can either attach directly to the toilet bowl or can be rested directly on top of an existing toilet seat/toilet bowl without being permanently attached. The hemorrhoid toilet seat (400) is equipped with attachment hinges that can used to permanently attach the toilet seat (400) to the toilet bowl if desired. These attachment hinges do not have to be used. If the user just wants to rest the hemorrhoid seat on top of the existing toilet seat or bowl without attaching these hinges can remain unused.

If the seat (400) is to just rest on the existing toilet seat or bowl seat stabilizer (450) must be used to stabilize the seat in place. In other words, stabilizers (450) must be extended to retain the seat (400) in place for the period it is being used so that the user is not injured should the seat (400) slide out from under them while being used. The stabilizer (450) can be permanently extended or in the alternative they can be retractable and adjustable. In other words, these stabilizers (450) can be made to universally fit standard toilet bowls and seats or can be adjustable to fit non-standard seats. These stabilizers are located in the body of the seat (410).

The seat is also equipped with a first pressure applicator (420) that is attached to the body of the seat (410) in a track (495) by track pins (440). The first applicator (420) divides a void into two specific portions. The first portion (415) and the second portion (435). The first applicator (420) can be moved into the first void (415) by sliding the first applicator (420) along the pin tracks (495) which results in making the space between the first and the second pressure applicators larger (420,430). The second pressure applicator (430) can be integrated directly into the seat or can be attached to the front of the seat so as to create a gap between the first applicator (420) and the second applicator (430). The gap can be adjusted, as described above, by sliding the first pressure applicator (420) closer and farther away from the second applicator (430). Moving the first pressure applicator (420) closer to the second pressure applicator (430) makes the second void (435) smaller and the first void (415) larger. Moving the first pressure applicator (420) farther away from the second pressure applicator (430) makes the first void larger and the second void (435) smaller.

The first pressure applicator (420) can contain a restricted portion (425). This feature aids in applying the exact pressure necessary to create a negative pressure in the body so as to draw the hemorrhoids back into the body. In one embodiment, the first pressure applicator (420) can be higher than the second pressure applicator (430).

Figure 6:
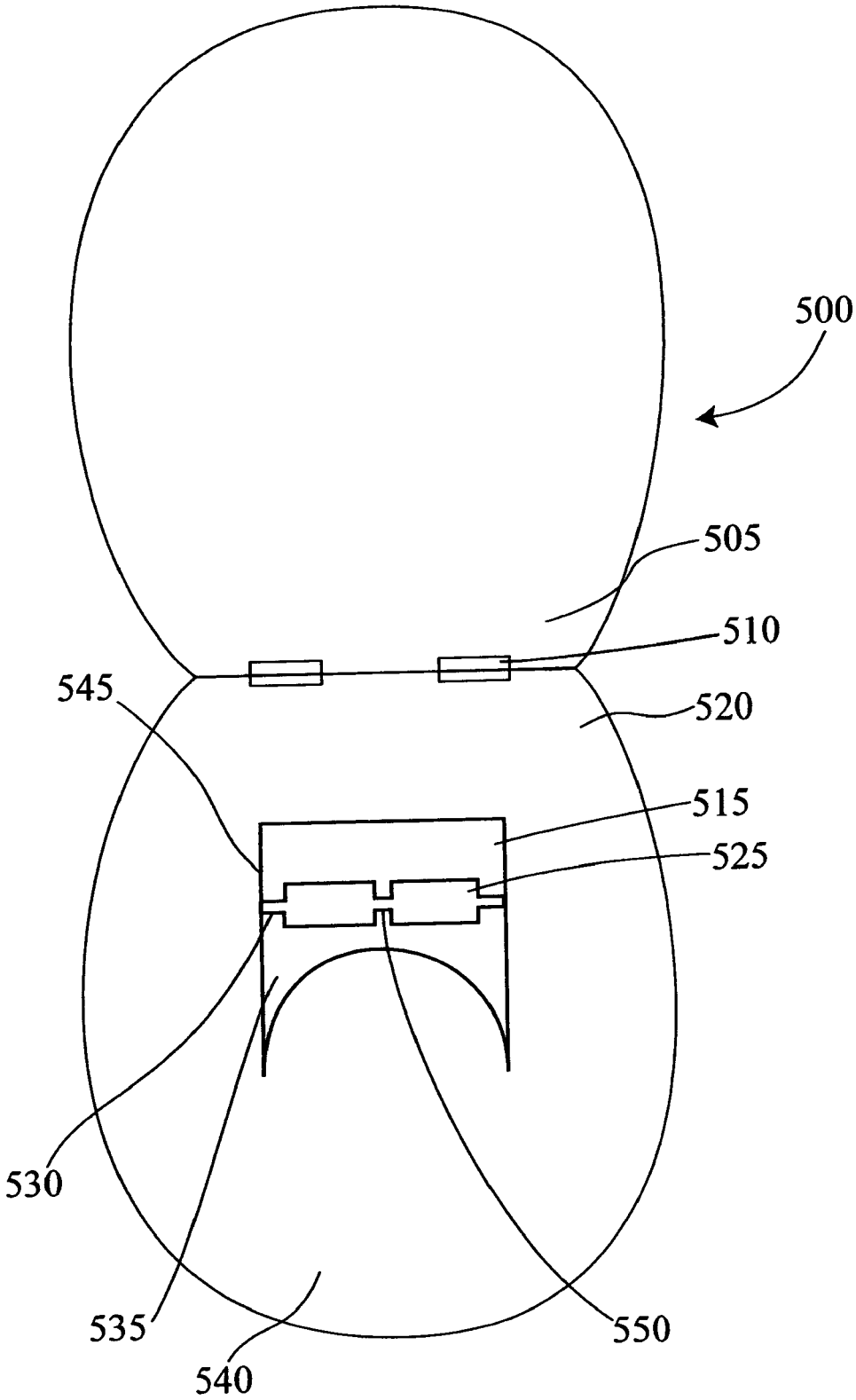

FIG. 6 shows a permanently attached hemorrhoid seat (500) having a cover (505) that can be closed so as to conceal the device when not in use. The cover (505) should be opaque so as not show the pressure applicators of the device. As in FIG. 5, the hemorrhoid seat (500) is equipped with attachment hinges (510) that can used to permanently attach the toilet bowl if desired. These attachment hinges (510) do not have to be used.

The seat is also equipped with a first pressure applicator (525) that is attached to the body of the seat (520) in a track (515) by track pins (530). The first applicator (525) divides a void into two specific portions. The first portion of the void (545) and the second portion (535). The first applicator (525) can be moved into the first void (545) by sliding the first applicator (525) along the pin tracks (515) which results in making the space between the first and the second pressure applicators larger (545,535).

The second pressure applicator (540) can be integrated directly into the seat or can be attached to the front of the seat so as to create a gap between the first applicator (525) and the second applicator (540). The gap can be adjusted, as described above, by sliding the first pressure applicator (525) closer and farther away from the second applicator (540). Moving the first pressure applicator (525) closer to the second pressure applicator (540) makes the second void (535) smaller and the first void (545) larger. Moving the first pressure applicator (525) farther away from the second pressure applicator (540) makes the first void (545) larger and the second void (535) smaller.

The first pressure applicator (525) can contain a restricted portion (550). This feature aids in applying the exact pressure necessary to create a negative pressure in the body so as to draw the hemorrhoids back into the body. In one embodiment, the first pressure applicator (525) can be higher than the second pressure applicator (540).

It is well understood that although the embodiments may be described as having a plurality of side walls, it is also within the scope of this application to use a circular or elliptical shaped seat that technically would not have side walls since there are no corners but would have portions instead. In other words, one skilled in the art would understand the seat to have at least three portions, namely a left side portion, a right side portion, and a back portion.

It should also be understood that a hard surface for purposes of this invention is a surface that is substantially firm but may have some sort of cushion or cloth material covering the hard surface. The surface must be able to apply positive pressure to an area that it comes in contact with.

In order to use the embodiments described above effectively the knees of the user must be raised from the floor. This can be accomplished by simply raising the feet of the user off of the floor without a rest or a foot rest can be used. The foot rest can be any existing foot rest or in the alternative can be a stack of magazines, wood or some other rest. One embodiment of the present invention is directed to an adjustable foot stool that can be easily stored and taken out when needed.

FIGS. 7A and 7B show a collapsible foot rest in the open and closed position. FIG. 7*a* shows the collapsible foot rest (600) in the open position. The foot rest can have a top (615) which can have imprints for where to place your feet (625). The bottom of the foot rest (605) can have cushions for the floor. The foot rest can also have sides (610, 620) that are in communication with top and the bottom of the foot rest. In the internal cavity of the foot rest is a collapsible means that can be extended and detracted to change the height of the foot rest.

FIG. 7B shows the collapsible foot rest in the collapsed position.

FIG. 8 shows another embodiment of the present invention directed to a portable or an attachable hemorrhoid seat having first and second pressure points applying portions that are configured to apply pressure around a hemorrhoid. FIG. 8 shows a hemorrhoid seat (800) having a first pressure applying portion (810) and a second pressure-applying portion (835) both configured to produce a narrowed gap between them in the void (820). That is, the first pressure point is an extension of the front portion (815) of the seat into the void (820) that is matched with a second pressure point (830) that is an extension of the back portion (815) of the seat (800) into the void (820) to produced a narrow gap (840) there between. The void (820 is formed by the front portion (815), the back portion (835), the left side (805) and the right side (825).

Like the other embodiments of the present invention the gap (840) between the two pressure points is configured so as to allow a person to sit on the seat (800) and position a hemorrhoid between the two pressure points. Once weight is applied downward the first and second pressure points will apply pressure around the hemorrhoid to allow the hemorrhoid to retract into the body and provide relief for the user.

While the invention has been illustrated and described with respect to specific illustrative embodiments and modes of practice, it will be apparent to those skilled in the art that various modifications and improvements may be made without departing from the scope and spirit of the invention. Accordingly, the invention is not to be limited by the illustrative embodiments and modes of practice.

What is claimed is:

1. A hemorrhoid treatment device comprising:

a seat having a front, back, left and right portions configured to form a void there between and to fit on and affixed to a toilet bowl, said seat having a gap formed between two pressure generating points positioned within said void, said pressure generating points formed by a narrowing of two opposing portions of said seat to form a gap within said void, wherein said two opposing portions of said seat are lobed-shape having at least one portion that extends further away from the rest of said lobed-shape and said opposing portions are said back and said front portions of said seat and said left and said right portions of said seat.

2. The hemorrhoid treatment device of claim 1 further comprising a lid configured to close over said seat.

3. A portable hemorrhoid treatment device comprising:

a seat having a front, back, left and right portions configured to form a void there between and to removably fit on a toilet bowl, said seat having a gap formed between at least two pressure generating points formed by a narrowing of two opposing portions of said seat that form a gap, wherein said at least two opposing portions of said seat are lobed-shape and said at least two opposing portions are said back and said front portions and said left and said right portions of said seat wherein said seat is configured to removably fit on a toilet bowl.

4. The portable hemorrhoid treatment device of claim 3 further comprising a handle on at least one portion of said seat configured for carrying said hemorrhoid seat.

* * * * *